US007318243B2

(12) United States Patent
Smith

(10) Patent No.: US 7,318,243 B2
(45) Date of Patent: Jan. 15, 2008

(54) LID SUPPORT AND FORMING SYSTEM FOR POOL COVER BOX

(75) Inventor: Lanny R. Smith, 815 W. Blue Spruce Rd., Alpine, UT (US) 84004

(73) Assignee: Lanny R. Smith, Alpine, UT (US)

( * ) Notice: Subject to any disclaimer, the term of this patent is extended or adjusted under 35 U.S.C. 154(b) by 0 days.

(21) Appl. No.: 11/320,257

(22) Filed: Dec. 27, 2005

(65) Prior Publication Data

US 2006/0150528 A1 Jul. 13, 2006

Related U.S. Application Data

(62) Division of application No. 10/637,421, filed on Aug. 8, 2003, now Pat. No. 7,011,782.

(51) Int. Cl.
*A47K 17/00* (2006.01)
*E04H 4/00* (2006.01)

(52) U.S. Cl. ..... 4/661; 4/502

(58) Field of Classification Search ..... 4/502, 4/661; 248/244–245; 220/345.1, 350
See application file for complete search history.

(56) References Cited

U.S. PATENT DOCUMENTS 2,982,508 A * 5/1961 Larsen et al. ..... 248/205.1
3,938,922 A 2/1976 Godley
4,159,100 A 6/1979 Landowski
4,181,286 A 1/1980 Van Doren
4,212,445 A * 7/1980 Hagen ..... 248/245
4,228,985 A 10/1980 Gaudelli et al.
4,251,196 A 2/1981 Toffolon et al.
4,321,024 A 3/1982 Terraillon
5,234,654 A 8/1993 Brooks
5,297,772 A 3/1994 Stefanick
5,332,191 A 7/1994 Nolan
5,372,349 A 12/1994 Elmore
5,542,837 A 8/1996 Johnston
2003/0141624 A1 7/2003 Takagi et al.
2003/0155683 A1 8/2003 Pietrobon

* cited by examiner

*Primary Examiner*—Charles E. Phillips
(74) *Attorney, Agent, or Firm*—Bryan G. Pratt; Rader, Fishman & Grauer PLLC

(57) ABSTRACT

A system is provided herein for supporting a lid for a pool cover box that includes (a) an elongated mounting element extending along substantially at least one wall of the pool cover box, and (b) a plurality of bracket assemblies, each adapted for connecting to the mounting element at multiple positions along the mounting element to support the lid.

1 Claim, 10 Drawing Sheets

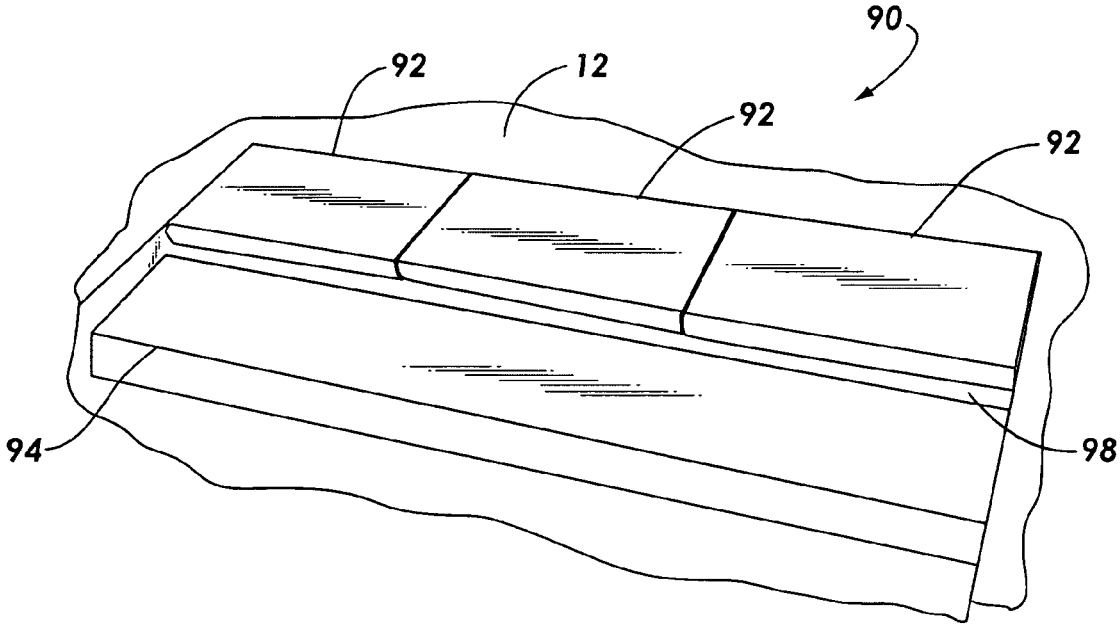
FIG. 9
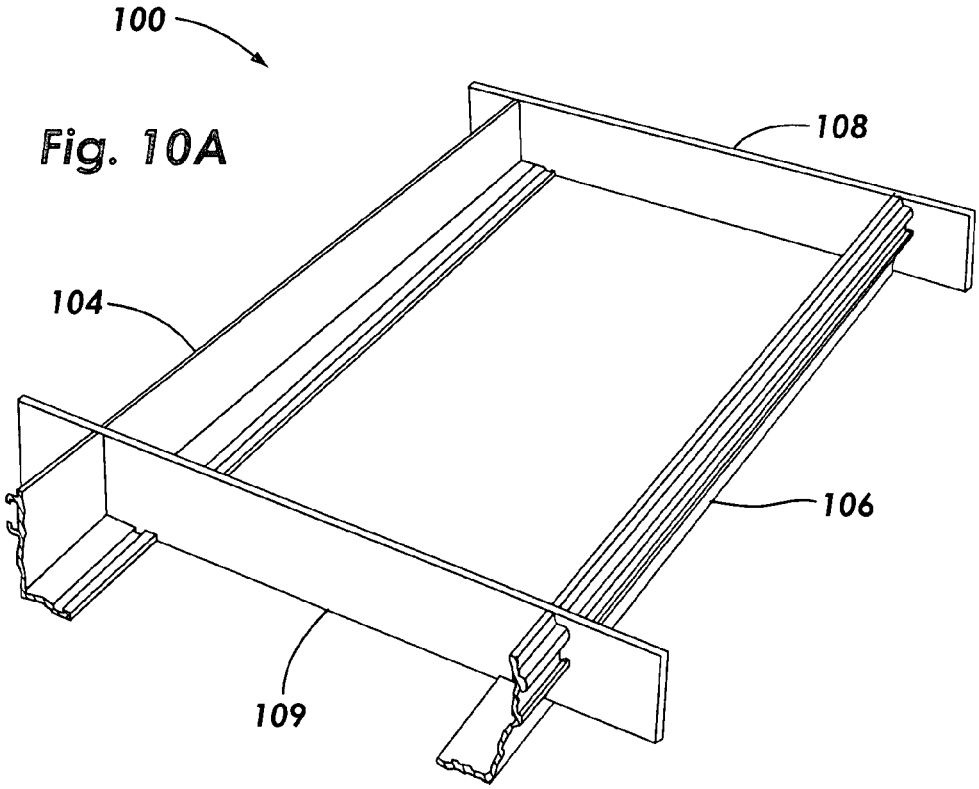

LID SUPPORT AND FORMING SYSTEM FOR POOL COVER BOX

RELATED APPLICATION

This application is a divisional U.S. patent application Ser. No. 10/637,421 filed on Aug. 8, 2003 now U.S. Pat. No. 7,011,782 and thus claims priority thereto.

FIELD OF INVENTION

The present disclosure relates to swimming pools, and, more particularly, to a lid support and forming system for pool cover boxes.

BACKGROUND

Swimming pool covers are often used for keeping the water free of trash, to shield the water from sunlight that could degrade protective chemicals in the water and for other purposes. Automatic pool covers are often preferable over manually-operated covers, because the cover can be easily extended when the pool is not in use and retracted during use. In most cases, a pool cover box is located at one end of the pool to hold the cover, motor, winding reel and cable.

To enhance the pool appearance, the pool cover box may be set in the decking flush with the rest of the deck and covered with a lid. Typically, the lid is formed in several sections to enable portions of the lid to be easily removed to access the box. The lid sections need to be adequately and evenly braced to support the weight of the lid and other forces that may traverse the lid surface. The lid sections should also be arranged so that they may be readily removed when access to the box is required.

Prior designs for a pool cover box and lid tend to add significantly to the cost of the pool. Typically, each section of the lid is custom fabricated and each support for the lid sections is permanently secured at a location on the box wall for the lid sections to be evenly supported.

Also, the pool cover box is often located at the front end of the pool, which is a focal point for the pool area. It may be desirable to cover over the pool cover box with aesthetically appealing material that coordinates in appearance with the pool deck and the rest of the pool surroundings. Sometimes, stone, masonry or other heavy materials may be used to enhance the visual effect. In such cases, a strong support is needed for the pool cover lid to support the weight of these materials.

SUMMARY

In one exemplary implementation, a system is provided for supporting a lid for a pool cover box comprising an elongated mounting element extending along substantially at least one wall of the pool cover box, and a plurality of bracket assemblies, each adapted for connecting to the mounting element at multiple positions along the mounting element to support the lid.

In another exemplary implementation, a method is also provided for supporting a lid on a pool cover box, comprising connecting an elongated mounting element to extend along substantially at least one wall of the pool cover box and connecting a plurality of bracket assemblies at spaced-apart positions along the elongated mounting element, to support the lid.

In yet another exemplary implementation, a system is provided for forming a lid for a pool cover box, comprising first and second form support elements spaced apart from each other, a base sheet, first and second lid forming elements, each being connected to one of the first and second form support elements and extending upward therefrom, and first and second wall elements disposed perpendicular to the first and second lid forming elements for forming said lid. In a further exemplary implementation, a method is also provided for forming a lid for a pool cover box, comprising (a) disposing first and second form support elements spaced apart from each other, (b) positioning a base sheet on the first and second form support elements, (c) connecting first and second lid forming elements to one of the first and second form support elements to extend upward therefrom, and (d) disposing first and second wall elements perpendicular to the first and second forming elements for forming said lid.

The implementations of the present application have several advantages. The lid support system provides a mechanism to secure a removable vertical form for shaping a vertical edge of a deck flush with a back wall of a pool cover box. The lid support system also provides a mechanism for hanging brackets to support lid sections without interfering with a pool cover rewind reel. In addition, the encapsulation track structure described in the implementations facilitates the placement of brackets, because they can be moved horizontally along the walls of the pool cover box for optimum positioning. Moreover, all brackets may be hung at the same vertical level, thereby enabling the lid sections to be level throughout.

The related lid forming system described herein also has several advantages. It is adjustable, enabling the fabrication of different sized lid sections for a pool box lid. The lid forming system is easily assembled and disassembled so that it may be reused. Because the lid forming system is small and portable, it can be readily transported to a location adjacent to a pool deck. This enables the pool cover lid to be poured at the same time as the pool deck, resulting in considerable savings. Furthermore, the pool cover lid sections may all be poured at the same time using the same form, so that lid fabrication time is greatly reduced. In addition, by fabricating the lid sections in the same form and at the same time, a uniformity of composition, appearance and sizing may be achieved. Finally, by minimizing the cost of forming concrete lids, it is more likely that lids can be made of concrete rather than using less desirable materials, such as aluminum. By using a concrete material for the lid that matches the deck material, a more uniform and aesthetically-pleasing overall pool appearance may be achieved.

BRIEF DESCRIPTION OF THE DRAWINGS

The above-mentioned features and other features and advantages of this disclosure will become more apparent and the disclosure will be better understood by reference to the following description of an exemplary implementation taken in conjunction with the accompanying drawings, wherein:

FIG. 9 is a perspective view of the lid sections extending over the pool cover box assembly according to the present disclosure;

FIG. 10A is a perspective view of a section of a lid forming system according to the present disclosure;

Throughout the drawings, identical reference numbers may designate similar, but not necessarily identical, elements. The examples herein illustrate selected implementations of the disclosure in certain forms, and such exemplification is not to be construed as limiting the scope of the disclosure in any manner.

DETAILED DESCRIPTION

Figure 1:
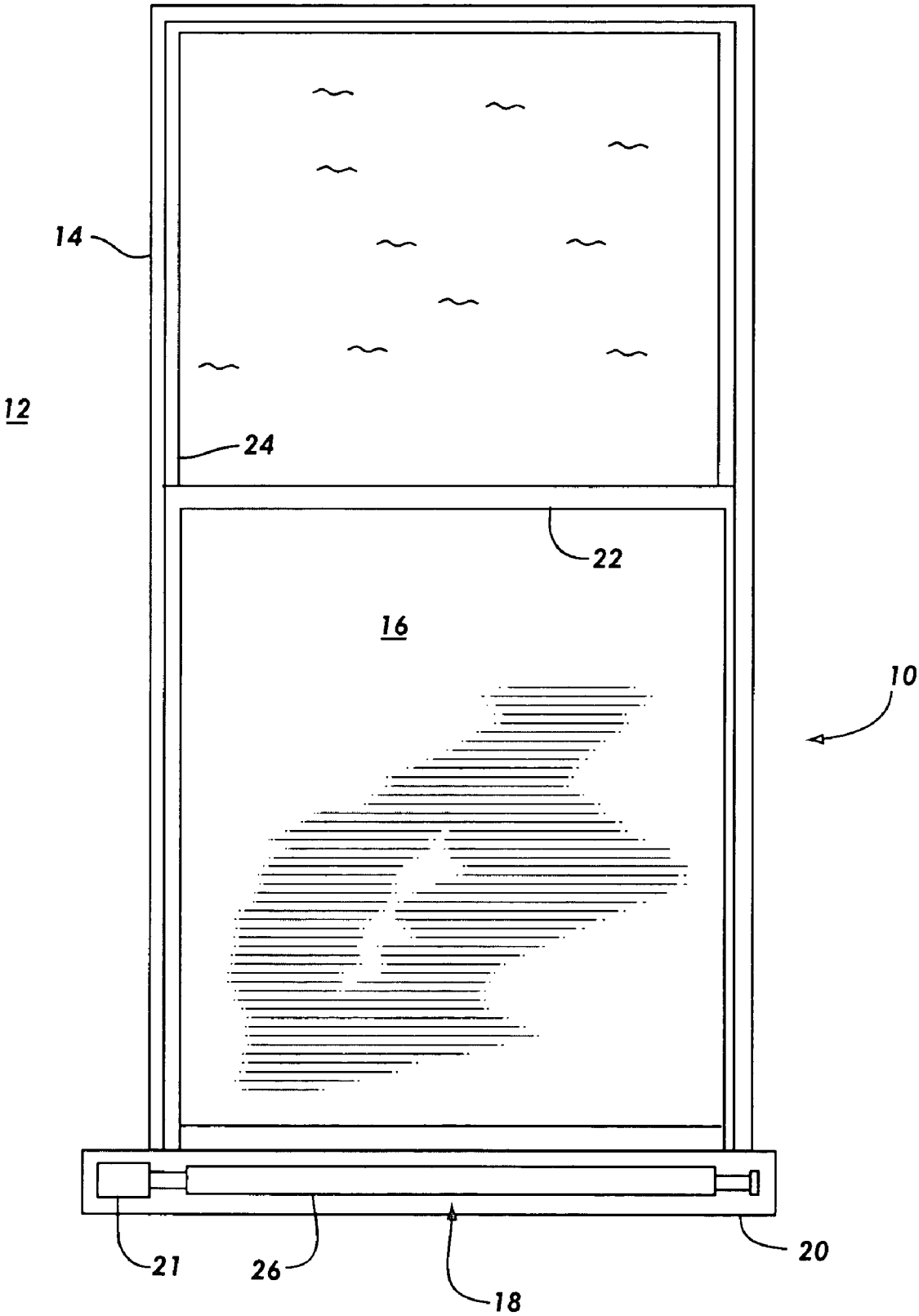
FIG. 1 is a plan view of a pool showing the location of the pool cover assembly according to the present disclosure.

Referring now to the drawings, and more particularly to FIG. 1, an implementation of a rectangular swimming pool 10 is shown having a pool deck 12 and coping walls 14 surrounding the pool 10. A pool cover 16 extends from a pool cover mechanism 18 in a cover assembly box 20 disposed at one end of the pool 10. A leading edge bar 22 at the front edge of the pool cover 16 rides in a track encapsulation 24 along the interior walls of the pool 10.

Deck 12 is generally horizontal and is preferably constructed from concrete. Coping 14 connects to deck 12 in a substantially coplanar fashion along the edge of deck 12 facing the interior of swimming pool 10. Encapsulation track 24 may include structure to retain vinyl lining, as well as fiber optic lighting along the length of coping 14 and above the level of leading edge bar 22 and cover 16.

When the pool is not in use, a leading edge bar 22 pulls cover 16 from pool cover box assembly 18 across the length of swimming pool 10. To use the swimming pool 10 the cover 16 is retracted by the pool cover assembly 18 into a cover assembly box 20 causing leading edge bar 22 to also retract into the assembly box 20. Leading edge bar 22 is connected to cover 16 and provides support along the leading edge of cover 16. Each end of leading edge bar 22 may be connected to at least one cable (not shown) and may further be slideably connected to the encapsulation track.

The foregoing discussion sets the environment for the lid support system embodiment and the lid forming system embodiment, which will now be described.

Lid Support System

Figure 2:
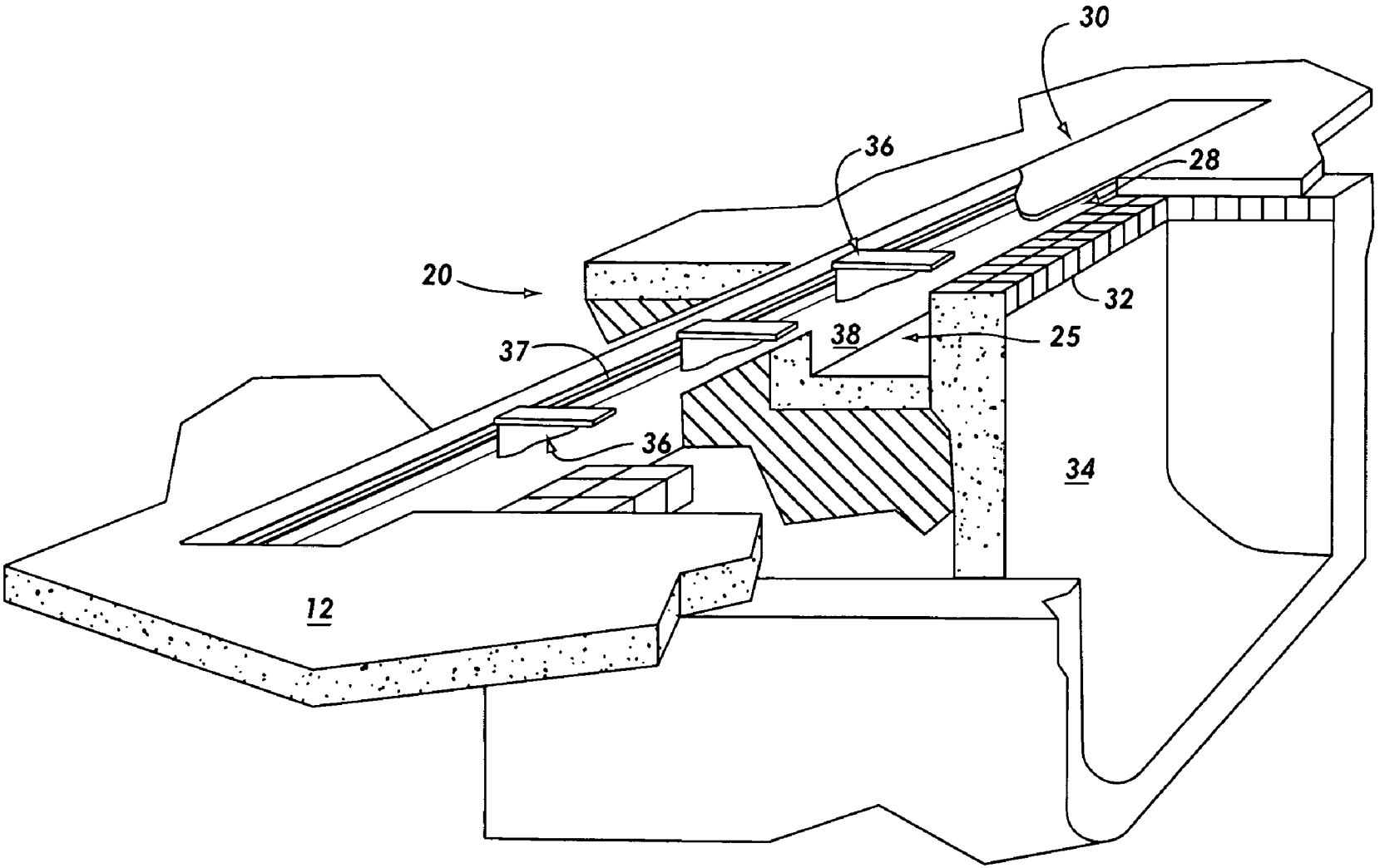
FIG. 2 is a perspective partial cutaway view of one end of a swimming pool having an automatic pool cover box assembly and support bracket according to the present disclosure.

Referring now to FIG. 2, the upper portion of the pool cover assembly box 20 is shown in more detail. The box 20 is preferably formed in a mechanism trough 25 extending below the surface of the deck 12. Pool cover assembly 18 (not shown here) lies in trough 25, extending the width of the pool. Referring again to FIG. 1, motor assembly 21 causes a roller member 26 of assembly 18 to rotate, thereby retracting the cover 16 over roller 26.

Pool cover box 20 may be made of a structural material such as concrete, wood or other suitable material. Box 20 must be large enough to accommodate the roller member, motor assembly and the pool cover. In some instances, the box 20 is about 14 inches deep by 14 inches wide. Box 20 may be somewhat wider than the pool 10. In order to accommodate the ends of the roller 26 and the motor assembly 21. As an example, if a pool is 16 feet wide, the box may be about 20 feet long, with extra length extending substantially equally beyond both sides of the pool.

Returning to FIG. 2, the lid 30 is composed of suitable material, such as aluminum or masonry, and extends over the cover assembly box 20 at a level substantially flush with deck (12). Lid 30 is shown in a partially cutaway view, to provide further detail. Normally lid 30 extends across the entire top of box 20, usually in multiple sections as seen in FIG. 9. A front coping 32 extends across the top of the front wall 34 of the pool 10 at a level below the deck 12. The vertical space between the front coping 32 and the lid 30 forms an opening 28 through which the pool cover 16 may be extended and retracted by the pool cover assembly 18 as shown in FIG. 1.

Lid 30 is supported by multiple support bracket assemblies 36 spaced from each other across the back wall 38 of the cover assembly box 20. Encapsulation track 37 is embedded in back wall 38 of box 20, extending the full length of back wall 38. Although not shown here, similar encapsulation bracket members may extend along one of more of the other walls in box 20. Bracket assemblies 36 are mounted along the back wall 38 so as to be movable horizontally along the wall 38 as needed. Bracket assemblies 36 support the weight of lid 30, as well as persons who may walk across the lid surface.

Figure 3:
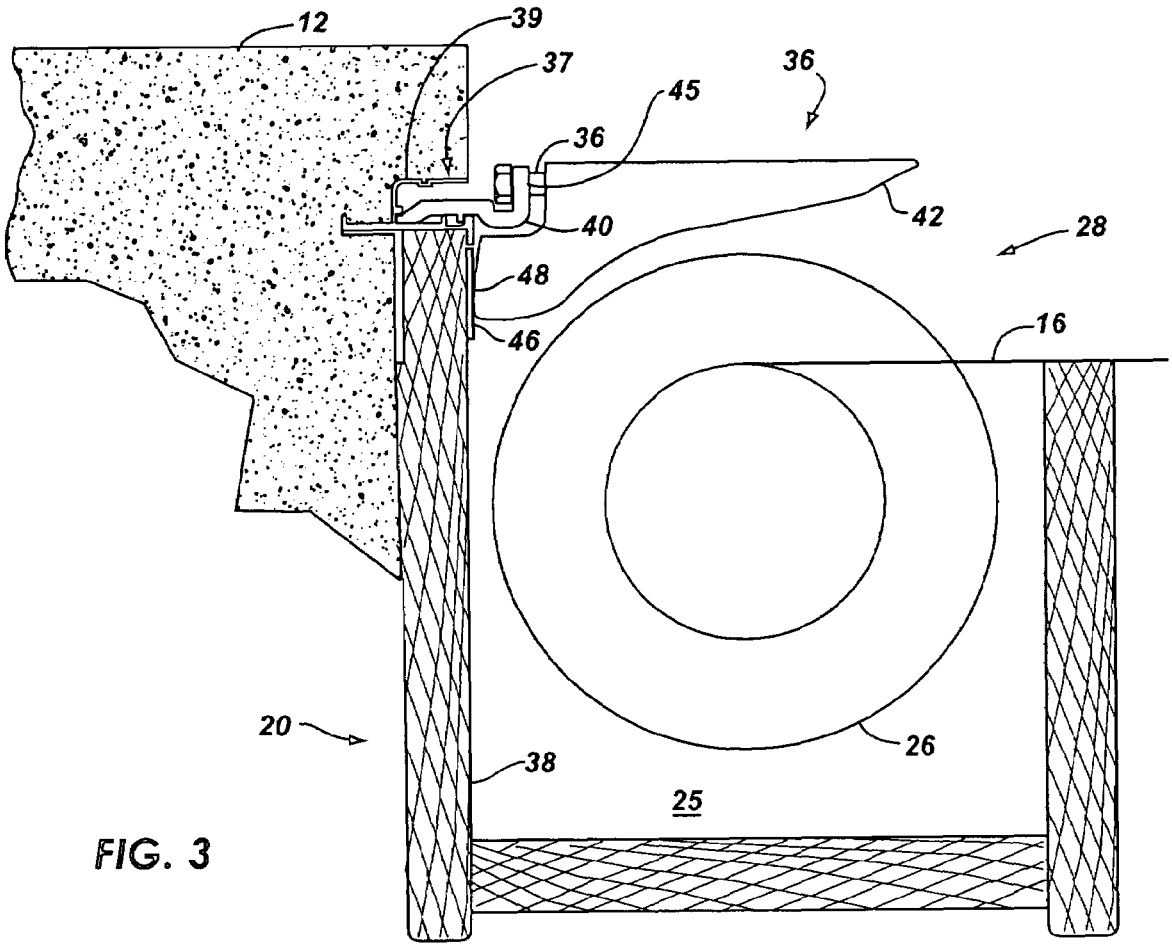
FIG. 3 is a partial cross-sectional view of the pool cover box assembly according to the present disclosure.

FIG. 3 shows the pool cover assembly 18 and cover assembly box 20 in more detail. Each bracket assembly 36 is mounted to the back wall 38 of box 20. The encapsulation track 37 is inset into a groove 39 in the decking 12 that runs horizontally just above the back wall 38 of assembly box 20. A bracket hook 40 is connected at one end to encapsulation track 37 by a structure shown in detail in FIGS. 5B and 6B. Bracket hook 40 includes a hooked end 43 extending outward to connect to a bracket 42 by a bolt 44 extending through an aperture in one end of the bracket hook 40. Bracket 42 extends horizontally across part of the width of box 20 to provide a broad even surface for supporting a lid member. A compression plate 46 is disposed between back wall 38 and the base 48 of bracket 42 for the purpose of distributing the force on the wall 38 exerted by base 48. Roller 26 is disposed in the trough 25 of box 20 to roll up or unwind the pool cover 16 as it retracts or extends through space 28.

Figure 4A:
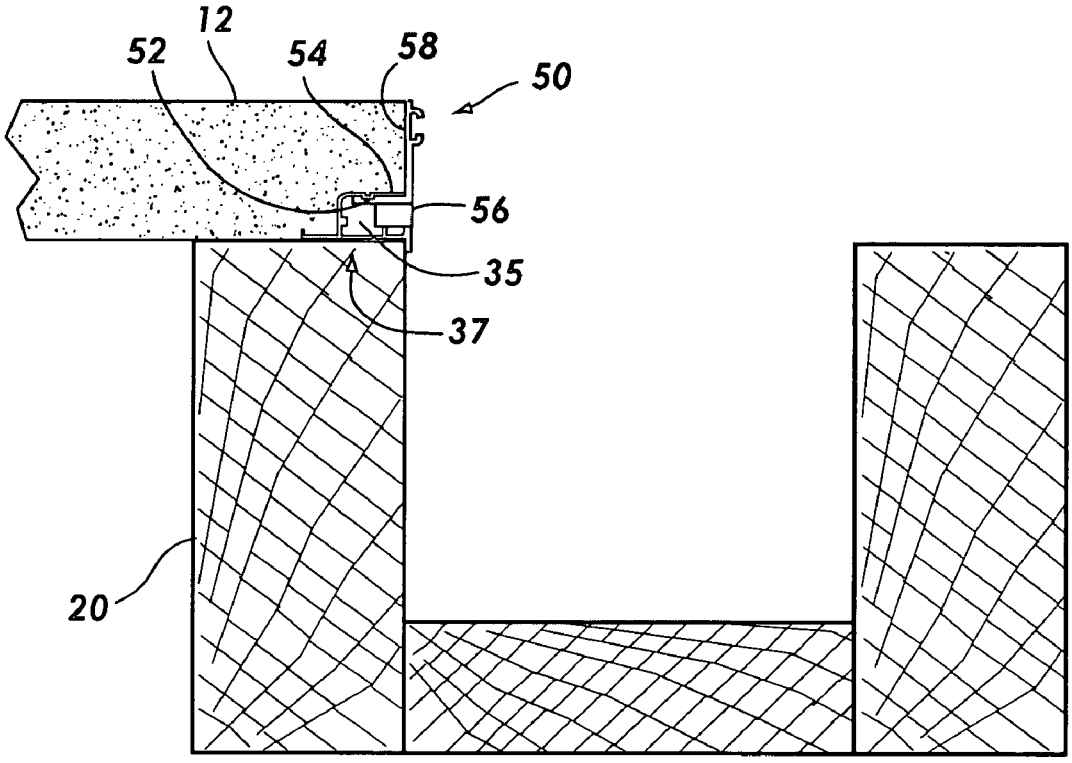
FIG. 4A is a cross-sectional view of the pool cover box assembly, showing construction of a deck member above the pool cover box.
Figure 4B:
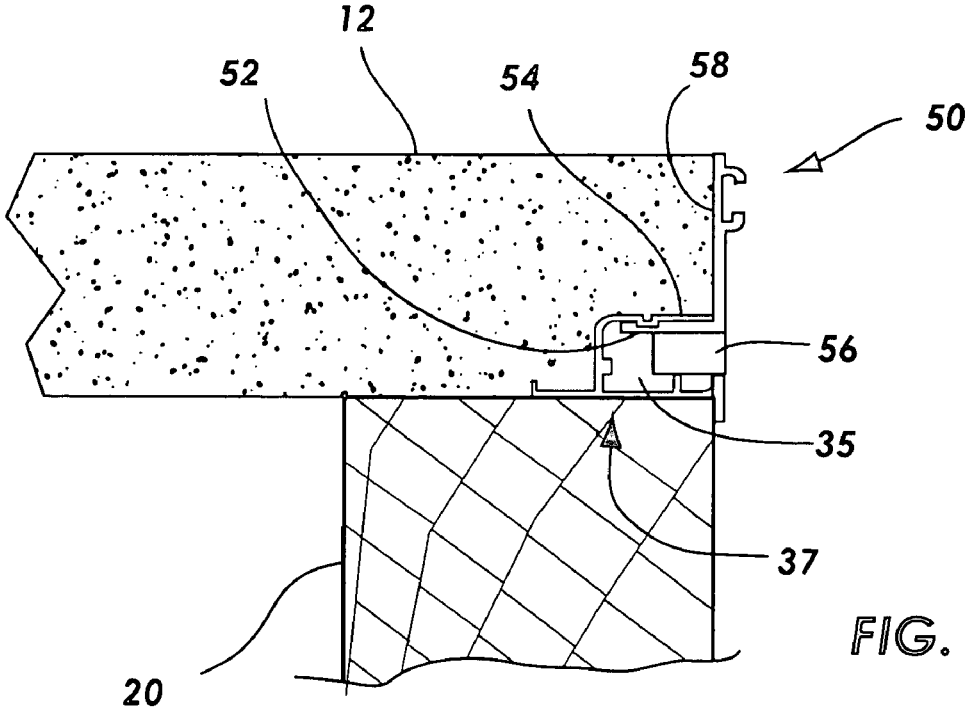
FIG. 4B is a close-up cross-sectional view of a portion of the pool cover box assembly shown in FIG. 4A.

FIGS. 4A and 4B show the manner in which the edge of deck 12 is formed. Encapsulation track member 37 is positioned on top of the back wall 38 of box 20. An L-shaped vertical box form 50 includes a lower portion 52 that is coupled to an upper portion 54 of track member 37 by an overlapping structure. A spacer 56 is inserted into an opening 35 to wedge between the lower portion 52 of vertical box form 50 and the lower portion 55 of track member 37 (see FIG. 6A). In this manner, the vertical box form 50 is secured in place while deck 12 is poured, so as to form a vertical edge 58 to deck 12.

Figure 5A:
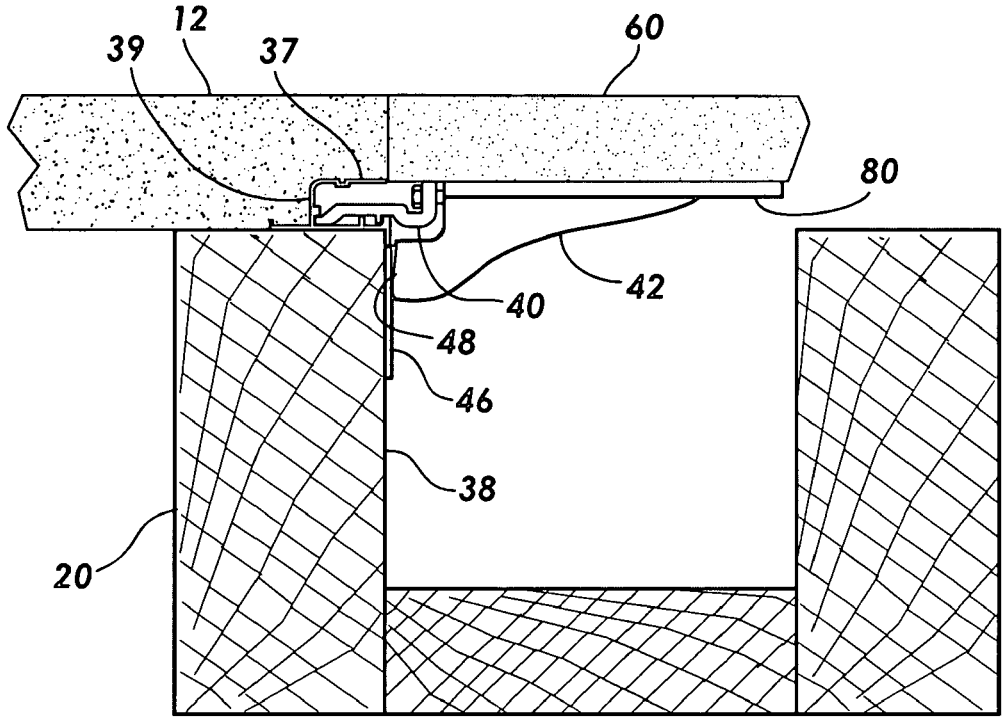
FIG. 5A is a cross-sectional view of the pool cover box assembly, showing a lid section being supported above the pool cover box.
Figure 5B:
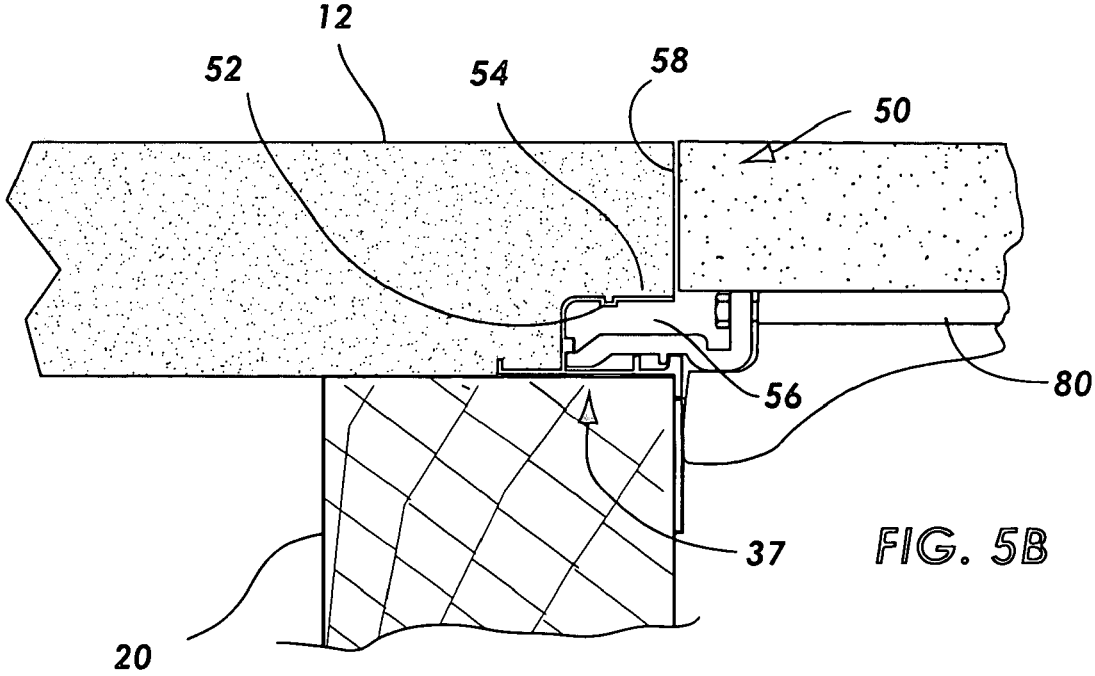
FIG. 5B is a close-up cross-sectional view of a portion of the pool cover box assembly shown in FIG. 5A.

In FIGS. 5A and 5B, the vertical box form 50 (shown in FIGS. 4A and 4B) has been removed. Encapsulation track member 37 is firmly secured in groove 39. Bracket hook 40 is snapped into position on track member 37 and has bracket 42 connected thereto as previously described. An extension member 80 is mounted on the top of bracket 42 to provide a larger surface area to support lid section 60. A lid section 60 is disposed and supported on the upper surface of extension member 80 and extends along the length thereof. Compression plate 46 is disposed between the base 48 of bracket 42 and the back wall 38 of box 20.

Figure 6A:
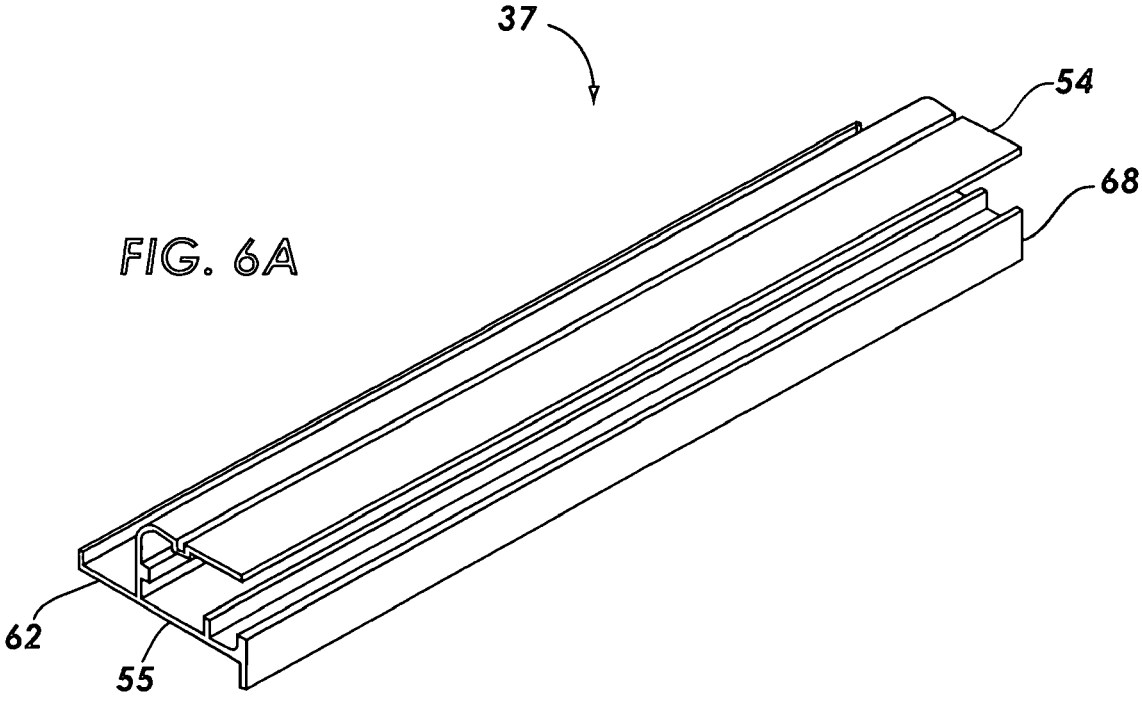
FIG. 6A is a perspective view of an elongated track assembly according to the present disclosure.
Figure 6B:
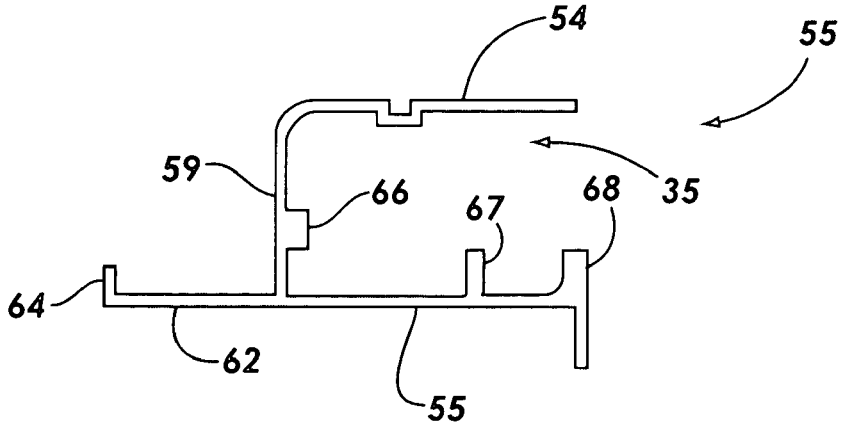
FIG. 6B is a side elevational view of the elongated track assembly shown in FIG. 6A.

FIGS. 6A and 6B show the encapsulation track 37 in greater detail. Encapsulation track 37 is a three-sided extrusion extending the width of the deck 12 (FIG. 1) and forming opening 35 for receiving bracket hook 40 (not shown here). Upper portion 54 of track 37 is connected to lower portion 55 by a vertical sidewall 59. A tail 62 extends outward with a hook 64 for securing the track 37 in the concrete deck. A tooth 66 extends from sidewall 59 into opening 35 for abutting the end of bracket hook 40 (See FIGS. 7A and 7B). A nub 67 extends from lower portion 55. An end member 68 extends upward into opening 35 and downward from the end of lower portion 55 to help secure track 37 to the back wall 38 of box 20 (not shown here).

Figure 7A:
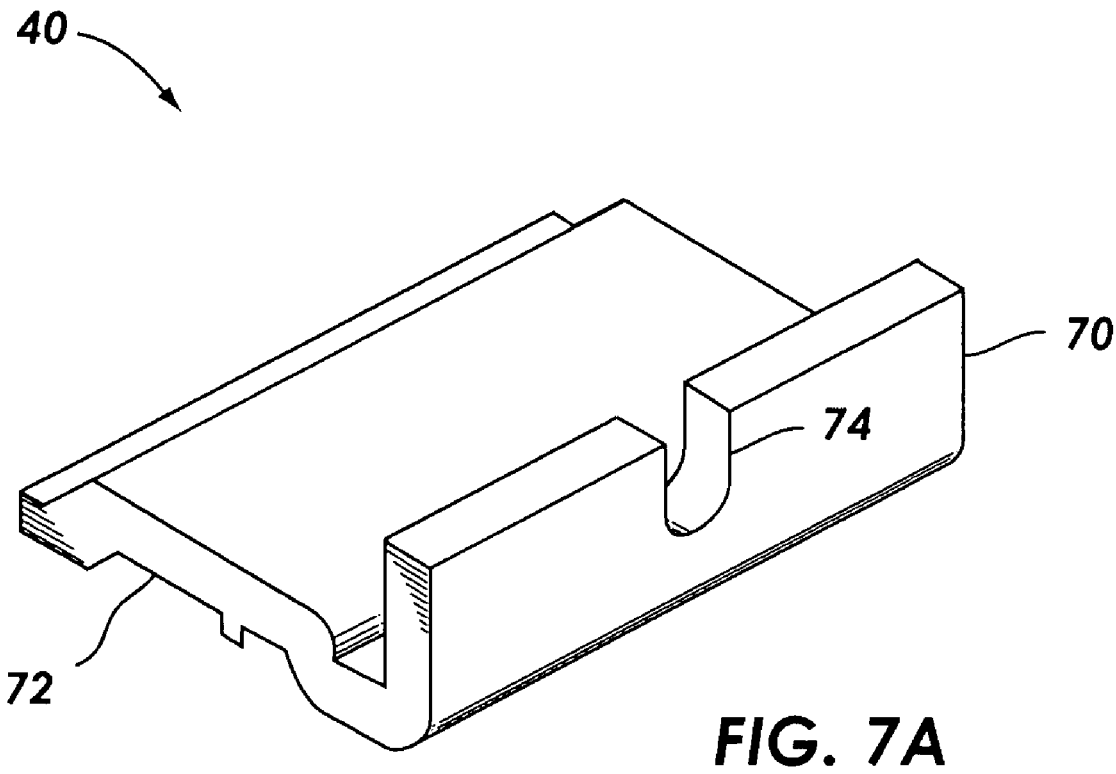
FIG. 7A is a perspective view of a hanger bracket according to the present disclosure.
Figure 7B:
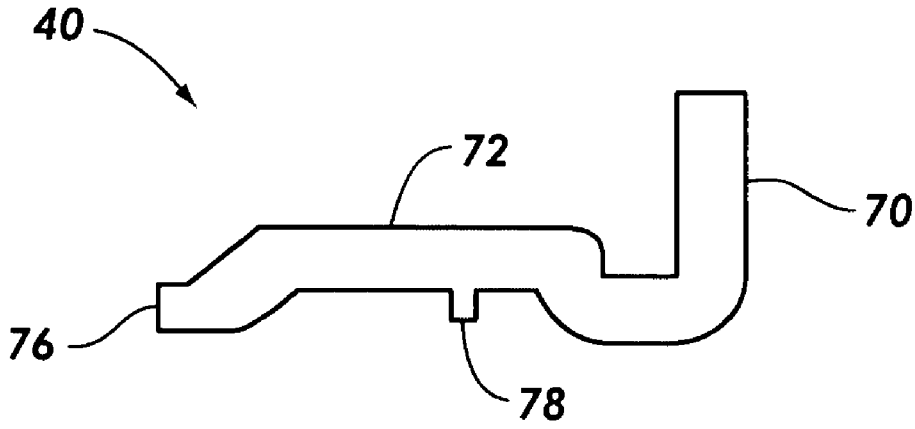
FIG. 7B is a side elevational view of the hanger bracket shown in FIG. 7A.

FIGS. 7A and 7B show the bracket hook 40 in greater detail. Bracket hook 40 is an L-shaped member having an upper portion 70 and a lower portion 72. A groove 74 in upper portion 70 is formed to receive bolt 44, shown in FIG. 3. Lower portion 72 includes an abutment 76 for abutting with tooth 66 shown in FIG. 6B. A tooth 78 extends from lower portion 72 to abut with lower portion 55 of track 37, shown in FIG. 6B.

Figure 8A:
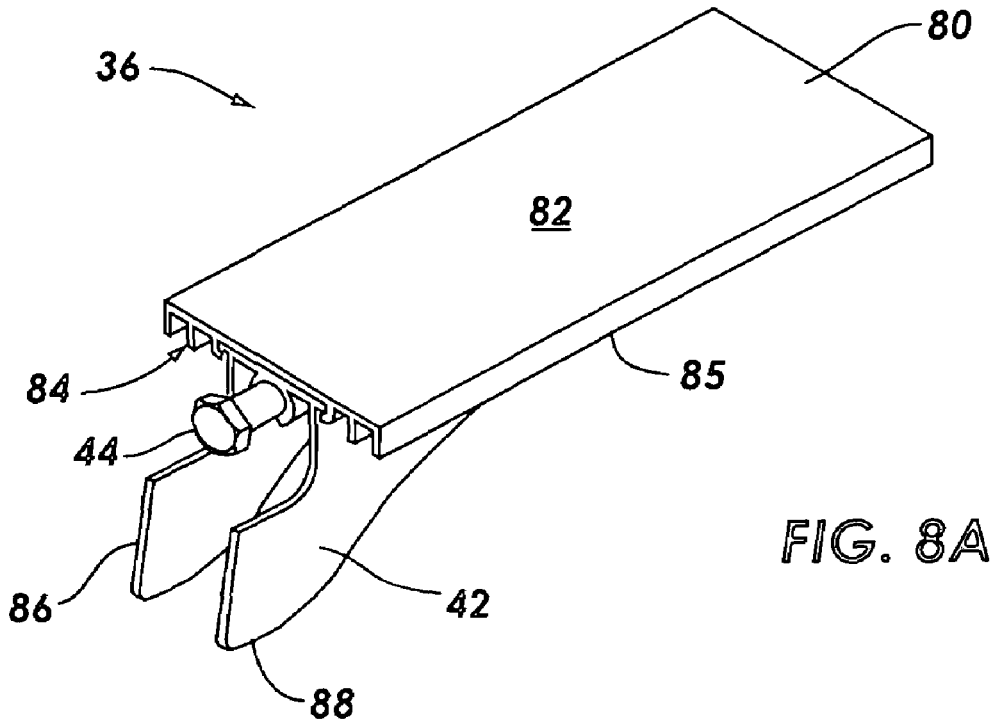
FIG. 8A is a perspective view of a support bracket used in the present disclosure.
Figure 8B:
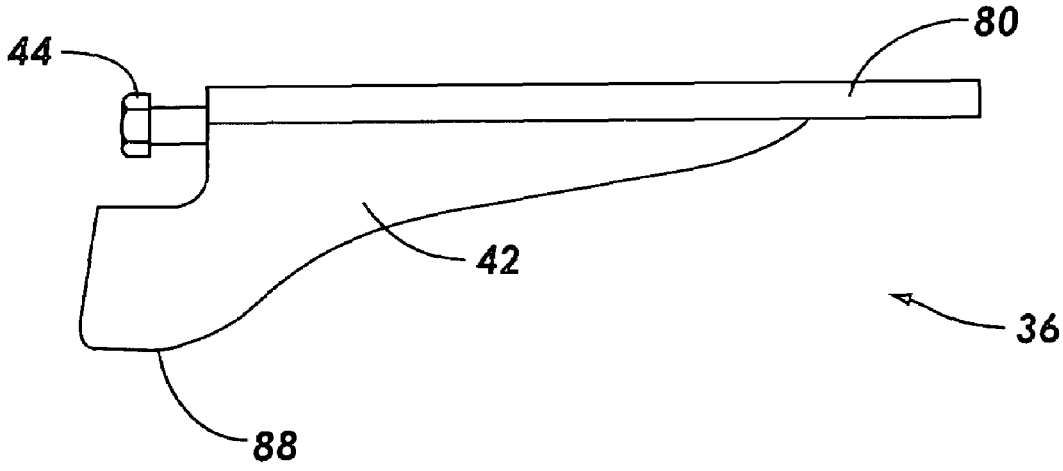
FIG. 8B is a side elevational view of the support bracket shown in FIG. 8A.

FIGS. 8A and 8B disclose bracket assembly 36 in greater detail. Bracket 42 includes flat extension member 80 having a smooth-top surface 82 for supporting concrete lid section 60, shown in FIG. 5A. The underside 84 of member 80 has a plurality of spaced channels 85 running the length of member 80. Two support legs 86 and 88 extend away from the underside 84 of bracket 42. A bolt 44 is connected to underside 84 to fit into groove 74, shown in FIG. 7A.

FIG. 9 discloses a perspective view of a lid 90, showing multiple lid sections 92 in place covering the box 20. Lid 90 may be composed of a variety of different materials and may match the composition and texture of the rest of the deck. Lid 90 extends over the box 20 (not shown here) at substantially the level of deck 12. A front coping 94 extends across the top of the front wall 96 of the pool at a level below the deck 12. The vertical space between the front coping 94 and the lid 90 forms an opening 98 (identical to opening 28 in FIG. 2) through which the pool cover 16 may be extended and retracted by the pool cover assembly 18.

When the pool cover 16 is fully retracted into box 20, the leading edge bar 22, shown in FIG. 1, may fit into opening 98. The encapsulation track 37 previously described may run around most of the perimeter of the pool cover box 20.

Several advantages are provided with the structure and methods of the present embodiments of the lid support system. First, they provide a mechanism to secure the vertical form 50 to form a vertical edge 58 of the deck 12 flush with back wall 38 of the pool cover box 20. After the deck 12 is formed, the form 50 may be removed. Second, the encapsulation track 37 provides a mechanism for hanging the brackets 42 for holding lid sections 60 without interfering with the pool cover rewind reel. Third, encapsulation track 37 facilitates the placement of brackets 42, because they can be moved horizontally along the walls of the pool cover box 20 for optimum positioning. Further, since encapsulation track 37 is disposed at the same level around the perimeter of box 20, all brackets 42 hung therefrom will be at the same vertical level, thereby enabling the lid sections 60 to be level throughout.

Lid Forming System

FIG. 10A depicts a portion of a form box 100 for forming each of the lid sections 92. Form box may be located on-site close to the pool cover box 20. The lid sections may be poured at the same time as the rest of the pool deck is poured, to minimize the expense of forming the lid. Form 100 is made of components that are easily assembled and disassembled, so that the form may be moved and reused. A vertical deck form 104 is disposed as one side of form 100, in order to form a vertical edge for the lid. A pool edge shape form 106 is disposed as the opposite side of form 100, in order to form a curved edge on the lid to match the coping of the pool deck. End member 108 is attached to one end of each of forms 104 and 106 by any conventional means. A separator plate 109 is positioned at the other end of forms 104 and 106. Forms 104*a* and 106*a* extend past separator plate 109 to indicate that additional identical forms may be added for additional lid sections.

Figure 10B:
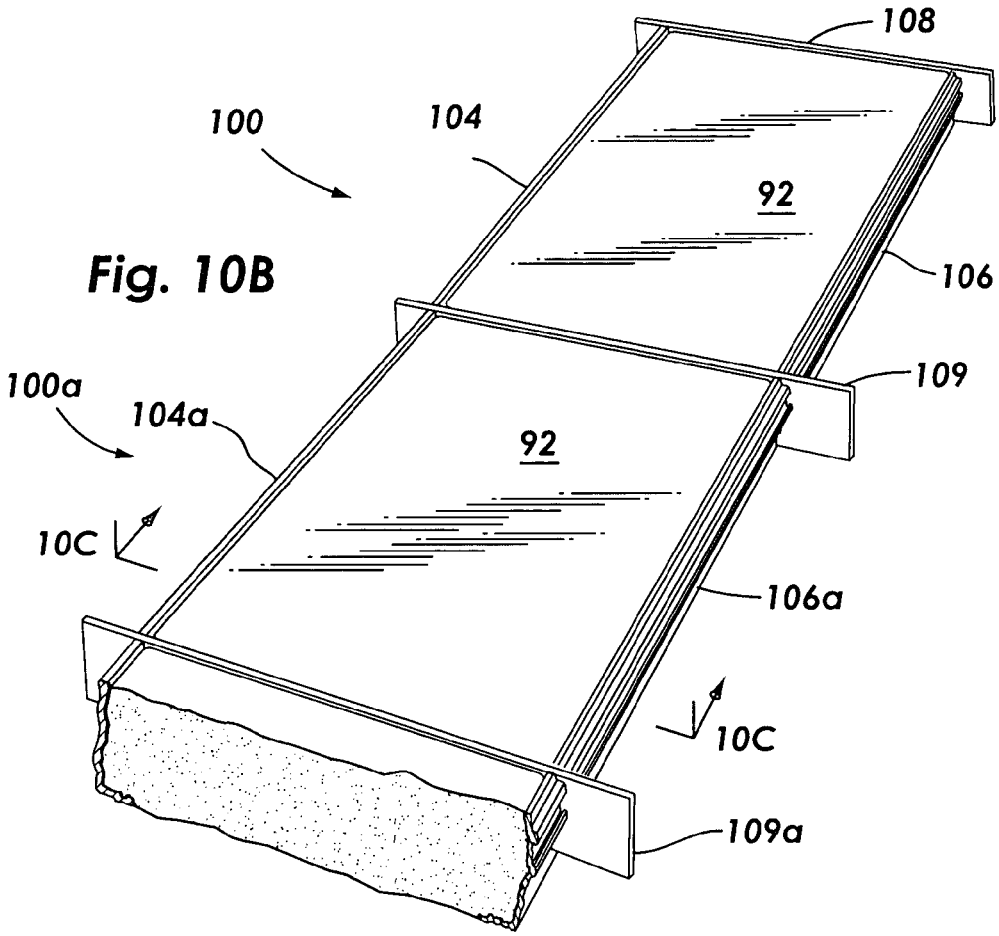
FIG. 10B is a perspective view of two sections of the lid forming system shown in FIG. 10A.

FIG. 10B shows form box 100 with another identical section having form box 100*a*. At the end of form box 100*a* is another separator plate 109*a* and the beginning of yet another form box section, defined by forms 104*b* and 106*b*. Additional form sections may be assembled, having various lengths, in order to conform to the length and width of the pool cover box 20 (FIG. 1). Once the form sections are assembled, the concrete lids 92 are poured, cured and set in place over the pool cover box.

Figure 10C:
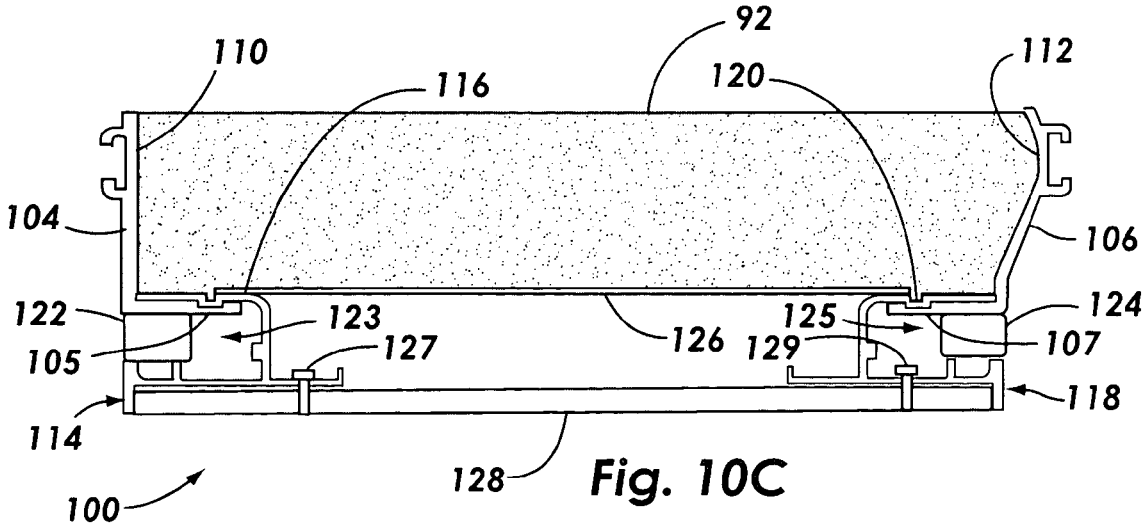
FIG. 10C is a cross-sectional view of the lid forming system shown in FIG. 10B.

FIG. 10C is a cross-section showing form 100 in more detail. Lid section 92 is poured between a vertical deck form 104 and a pool edge shape form 106. Vertical deck form 104 provides for a vertical straight edge 110 to fit deck edge 58, shown in FIG. 4A. The pool edge shape form 106 makes a curved edge 112 that may match the shape of the rest of the pool edging.

Form 104 is an L-shaped member having a base portion 105 that extends beneath lid section 92. Likewise, form 106 is an L-shaped member having a base portion 107 that extends beneath lid section 92. An encapsulation member 114 is disposed beneath form 104 and has a top portion 116 that interconnects with base portion 105 of form 104. Likewise, an encapsulation member 118 is disposed beneath form 106 and has a top portion 120 that interconnects with base portion 107 of form 106.

It should be noted that encapsulation members 114 and 118 are essential identical or very similar in the structure of encapsulation track member 37, shown in FIGS. 2-6B. In fact the same product may be used for both forming an encapsulated track 37 and encapsulation members 114 and 118.

A spacer 122 is wedged in a groove portion 123 of encapsulation member 114 beneath the base portion 105 of form 104 to hold base portion 105 in contact with top portion 116 of encapsulation member 114 while the concrete lid 92 is poured and cured. Likewise, a spacer 124 is wedged in a groove portion 125 of encapsulation member 118 beneath the base portion 107 of form 106, so as to hold base portion 107 in contact with top portion 120 of encapsulation member 118 while the concrete lid 92 is poured and cured.

A metal sheet comprising a bottom form member 126 is supported at one end by top portion 116 of encapsulation member 114 and at the other end by top portion 120 of encapsulation member 118. A base member 128 extends the entire length of the form sections 100, 100*a* and so forth. Each section is secured to the base member by pins 127 and 129.

After lid section 92 is formed and cured, spacers 122 and 124 are removed, enabling forms 104 and 106 to be disassembled from encapsulation members 114 and 118. Lid section 92 may then be removed and placed on brackets 42 over the pool box 20 as previously shown.

The lid forming system described above has several advantages. The lid forming system is adjustable, enabling the fabrication of different sized lid sections 60. It is easily assembled and disassembled so that it may be reused. Because the lid forming system is small and portable, it can be readily transported to a location adjacent to the pool deck. This enables the pool cover lid to be poured at the same time as the pool deck, resulting in considerable savings. Furthermore, the pool cover lid sections 60 may all be poured at the same time using the same form, so that lid fabrication time is greatly reduced. In addition, by fabricating the lid sections 60 in the same form and at the same time, a uniformity of composition, appearance and sizing may be achieved. Finally, by minimizing the cost of forming concrete lids, it is more likely that lids can be made of concrete rather than using less desirable materials, such as aluminum. By using a concrete material for the lid that matches the deck material, a more uniform and aesthetically-pleasing overall pool appearance may be achieved.

While this disclosure has been described as having a preferred design, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method for forming a deck and supporting a lid on a pool cover box comprising:

(a) connecting an elongated mounting element to extend along substantially at least one wall of the pool cover box, (b) connecting a vertical box form to the elongated mounting element to assist in forming a deck member above the pool cover box, forming a deck, removing said vertical box form and, (c) connecting a plurality of bracket assemblies at spaced-apart positions along the elongated mounting element, to support the lid.

* * * * *